US005887740A

United States Patent [19]

Hong

[11] Patent Number: 5,887,740

[45] Date of Patent: Mar. 30, 1999

[54] CONTAINER FOR SEASONINGS SUCH AS SALT, PEPPER AND SPICES

[76] Inventor: Park Hong, P.O. Box 87-175, Taipei, Taiwan

[21] Appl. No.: 395,719

[22] Filed: Feb. 28, 1995

[51] Int. Cl.[6] ..... B65D 21/036

[52] U.S. Cl. ..... 220/4.27; 206/508

[58] Field of Search ..... 222/480, 565, 222/143; 220/4.27, 4.26; 206/508, 509

[56] References Cited

U.S. PATENT DOCUMENTS

| | | | |
|---|---|---|---|
| 2,077,027 | 4/1937 | Torras | 206/508 |
| 2,663,450 | 12/1953 | Bourcart | 220/4.27 |
| 3,018,931 | 1/1962 | Westgate | 222/480 |
| 3,067,896 | 12/1962 | Berg et al. | 220/4.27 |
| 3,369,691 | 2/1968 | Wei | 220/4.27 |
| 4,294,924 | 10/1981 | Pepicelli et al. | 220/4.27 |
| 4,429,786 | 2/1984 | Hucal | 220/4.27 |
| 5,086,926 | 2/1992 | Paige et al. | 220/4.27 |
| 5,401,200 | 3/1995 | Ellis | 220/4.27 |

*Primary Examiner*—Stephen J. Castellano
*Attorney, Agent, or Firm*—Keith Beecher; Richard Sleher

[57] ABSTRACT

A stackable container for seasonings which comprises a hollow cylinder having an integral top wall and an integral bottom wall. An integral upwardly extending tubular mouth member of reduced diameter is formed on the top wall and centrally located on the top wall coaxial with the cylinder. The bottom wall has an upwardly extending centrally located circular well coaxial with the cylinder. The well has a selected diameter to receive the tubular mouth of a like container to enable the containers to be stacked over one another in a stable tier.

3 Claims, 2 Drawing Sheets

CONTAINER FOR SEASONINGS SUCH AS SALT, PEPPER AND SPICES

BACKGROUND OF THE INVENTION

The present invention is directed to a container for seasonings such as salt, pepper, spices, and the like. The container is constructed so that it can be stacked in an interlocking relationship with other like containers in a stable tier. The construction is such that the individual containers are able to maintain their interlocked relationship even when the tier is lifted up from the supporting surface and held in an inclined position.

Conventional containers for seasonings are usually formed of a hollow body having a mouth at the top of the body, and having a cover removably mounted on the mouth. It is essential that the cover be positioned on the mouth in a moisture-tight fit. Otherwise, moisture may enter the container and cause the seasonings to deteriorate. Furthermore, since various seasonings, including salt, pepper, spices, and the like, are normally used in kitchens, it is convenient for a plurality of similar seasoning containers to be provided. In accordance with the present invention, the seasoning container is constructed so that it may conveniently and easily be stacked over like containers to conserve table space.

Accordingly, it is an object of the present invention to provide a seasoning container that can be stacked over like containers in a stable tier to conserve table space. Moreover, another objective of the invention is to provide such a container which may be interlocked with other like containers in the tier with all the containers tightly fitted into one another so that the resulting tier is sturdy and stable, and so that there is no likelihood of the containers falling off each other in the event the tier is tilted.

Another object of the invention is to provide such seasoning containers which when stacked are configured so that each container in the stack provides a protective envelope around the mouth of the next lower container further to assure that moisture will not enter into the interiors of the individual containers.

SUMMARY OF THE INVENTION

The present invention provides a stackable seasoning container which is formed of a hollow cylindrical body having an integral top wall and an integral bottom wall. A tubular mouth is located at the center of the top wall in coaxial relationship with the cylindrical body, with the mouth projecting upwardly from the plane of the top wall. The annular portion of the top wail surrounding the mouth may be slightly convex. A cover is threaded or otherwise removably fitted over the tubular mouth. In addition, a perforated cap may be fitted over the mouth under the cover to permit the seasoning contained in the container to be sprinkled through the perforations of the cap when the cover is removed.

The integral bottom wall of the cylindrical body of the container has a centrally located well coaxial with the cylindrical body which has a diameter selected to receive the cover and tubular mouth of a like container. This permits a number of the seasoning containers to be stacked in a stable tier by fitting the mouth and cover of one container into the well of another.

The bottom wall of the cylindrical body of the container has a concave surface so that it will fit smoothly over the convex surface of the top of the like container. In this manner the containers may be arranged in a stable tier with the mouth and cover of each container being received in a tight fit in the well of the next upper container in the tier. In each instance the upper container also serves to maintain the next lower container in a moisture-proof condition.

DETAILED DESCRIPTION OF THE ILLUSTRATED EMBODIMENT

Figure 1:
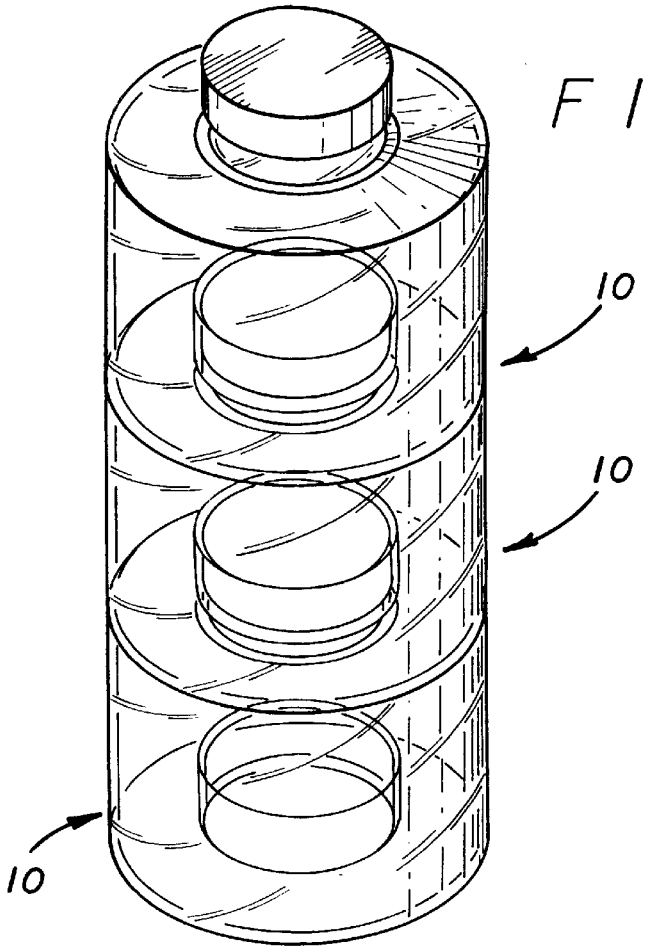
FIG. 1 is a perspective view of a number of containers, each constructed in accordance with the teaching of the present invention, stacked together into a tier.
Figure 2:
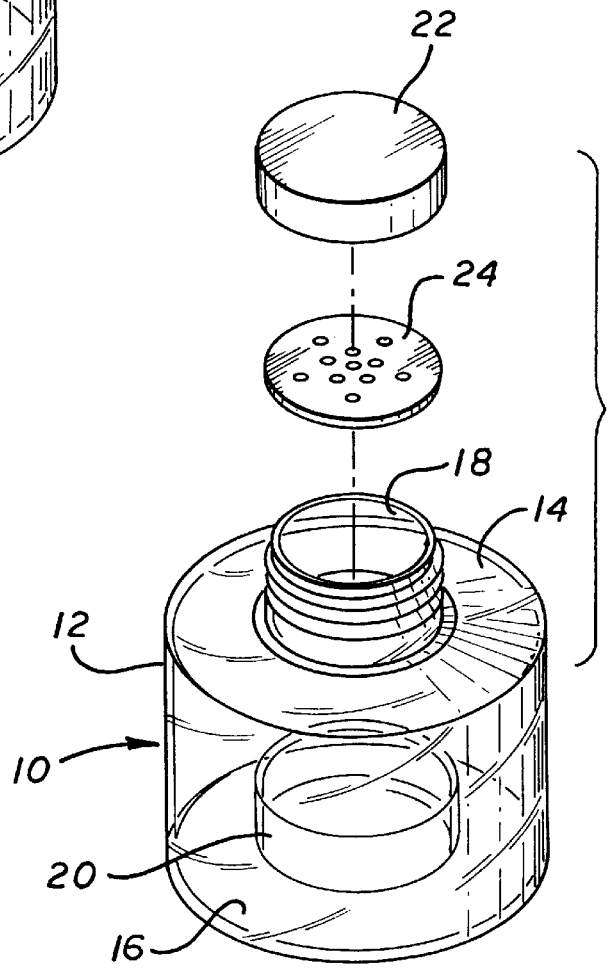
FIG. 2 is a perspective view of one of the containers of FIG. 1 with various elements displaced to illustrate the structure of the elements.

The container shown in the drawings is designated generally as 10. The container includes a hollow cylindrical body portion 12 of a selected diameter and having an integral top wall 14 and integral bottom wall 16. A tubular mouth member 18 is formed integral with the top wall 14 and has a reduced diameter with respect to the diameter of the body portion 12. The tubular mouth member 18 is centrally formed on the top wall 14 in coaxial relationship with the body portion 12.

A circular well 20 is formed integral with the bottom wall 16, and the well extends upwardly into the interior of the body 12. The well 20 has a selected diameter so that each well will receive the mouth member 18 and its cover 22 of a like container is a close fit interlocking relationship when the containers are stacked on top of one another, as shown in FIGS. 1 and 3.

The annular portion of the top wall 14 surrounding the tubular mouth 18 has a convex configuration and the annular portion of the bottom well 16 has a concave configuration surrounding the well 20. This enables the various containers to mate with one another in a smooth relationship when they are stacked in the positions shown in FIGS. 1 and 3.

Figure 3:
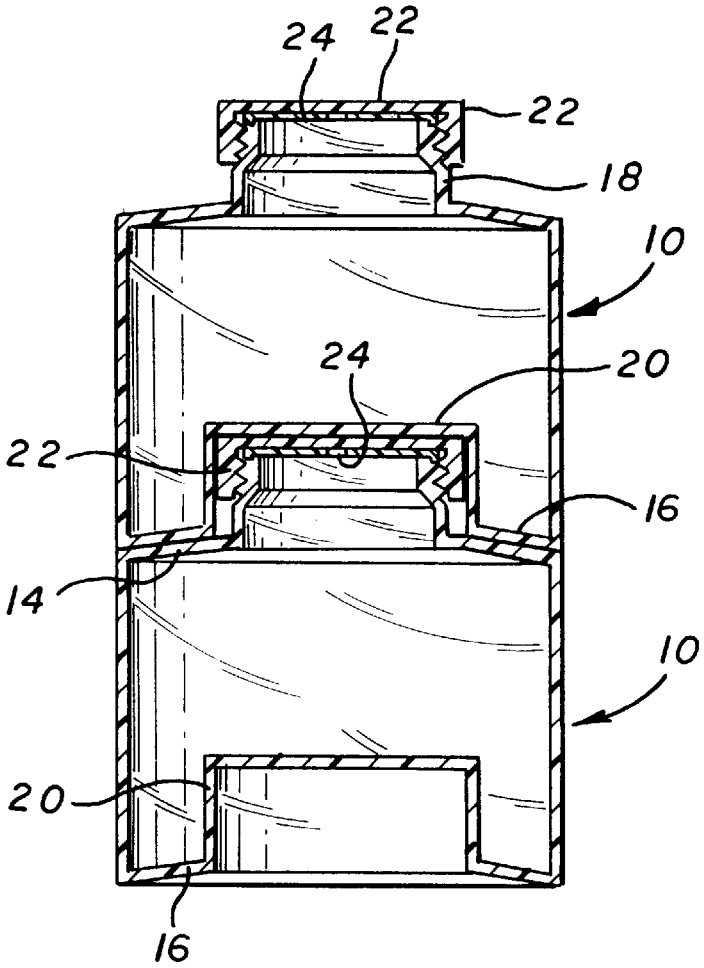
FIG. 3 is a side section showing two of the containers of FIG. 2 being stacked on one another.

As stated above, the diameter of the well 20 and the diameter of cover 22 and mouth 18 are selected so that each container in the tier of FIGS. 1 and 3 will be held in a tight interlocking relationship. However, the relationship is not a 1 friction fit, but sufficiently free so that one container may be easily lifted from the next lower container. At the same time, the relationship is such that the tier is stable so as to reduce the likelihood of the containers falling off one another when the stack is lifted off the supporting surface.

Figure 4:
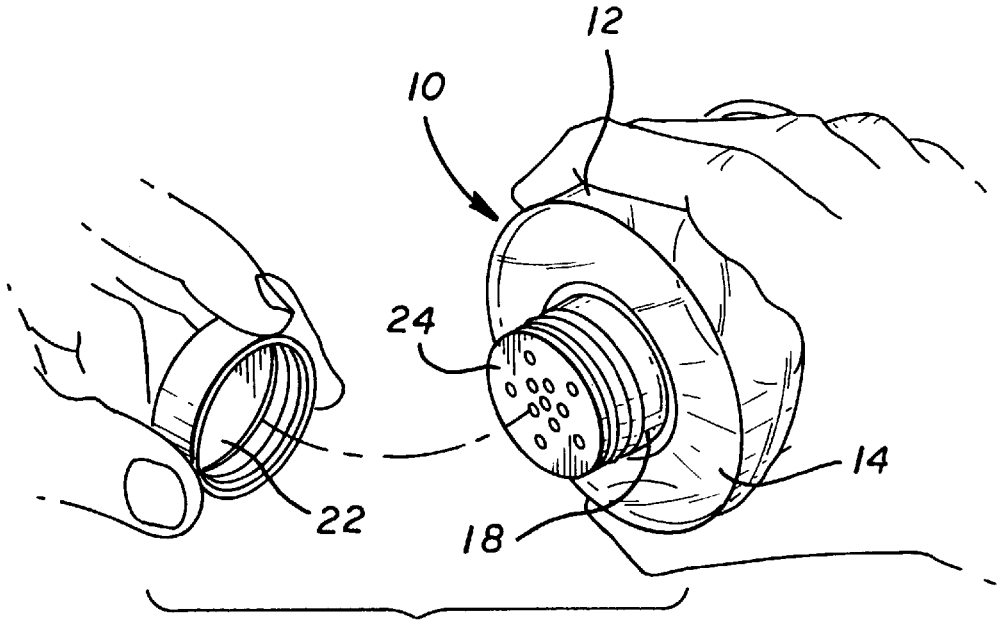
FIG. 4 is a perspective view showing the cover removed from the mouth of the container of the invention to permit appropriate seasoning to be sprinkled through perforations in a cap fitted over the mouth.

A perforated cap 24 is fitted on the tubular mouth member 18 under the cover 22 to permit the contents of the container to be sprinkled through the cap when the cover is removed, as shown in FIG. 4.

The invention provides, therefore, a simple and inexpensive seasoning container which is preferably transparent, and which may be formed of glass or transparent plastic. The container is stackable and, as described, may be stacked on top of like containers in a stable interlocked tier. The container also has the feature that it is moisture-proof and protects the integrity of the seasoning contained therein.

It will be appreciated that while a particular embodiment of the invention has been shown and described, modifications may be made. It is intended in the following claims to cover all such modifications which fall within the true spirit and scope of the invention.

I claim:

1. A first stackable container for seasoning, comprising:

a hollow cylinder having an integral top wall and an integral bottom wall, a tubular mouth member formed integral with the top wall and centrally located on the top wall coaxial with the hollow cylinder, said tubular mouth member having external threads thereon and having a reduced diameter with respect to the diameter of said top wall and extending upwardly from the plane of said top wall;

said bottom wall having a circular well centrally formed therein coaxial with said cylinder and extending upwardly into the interior of said cylinder, and said well having a selected diameter to receive the tubular mouth member of a second like container to enable the first container to be stacked on top of the second container;

a cover having an internally threaded annular skirt portion removably mounted on said tubular mouth member in threaded engagement therewith and with said skirt portion extending down over said tubular mouth member, and in which the outer diameter of the annular skirt portion of said cover and the inner diameter of the well are selected to enable the first container to be stacked over the second container in a close fitting sliding interlocking relationship; and a perforated cap fitted over said tubular mouth member under said cover.

2. The container defined in claim 1, in which said top wall has an annular convex surface surrounding the tubular mouth member, and the bottom wall has a concave annular surface surrounding the well to receive the convex top surface of the top wall of the second container in a smooth-fitting relationship.

3. The container defined in claim 1 in which said cylinder is formed of a transparent material.

* * * * *